United States Patent [19]

Kefauver et al.

[11] 4,030,271

[45] June 21, 1977

[54] APPARATUS FOR CAPPING AND UNCAPPING CONTAINERS

[75] Inventors: Bernard C. Kefauver, Frederick; Norman Little, Silver Spring, both of Md.

[73] Assignee: The United States of America as represented by the Secretary of the Department of Health, Education and Welfare, Washington, D.C.

[22] Filed: June 11, 1976

[21] Appl. No.: 695,171

[52] U.S. Cl. ..... 53/305; 53/317; 53/331.5; 53/381 A

[51] Int. Cl.[2] ..... B65B 7/28; B67B 3/20; B67B 7/18

[58] Field of Search ..... 53/305, 317, 318, 331.5, 53/381 A, 390, 392

[56] References Cited

UNITED STATES PATENTS

| | | | |
|---|---|---|---|
| 1,169,775 | 2/1916 | Cornwall | 53/305 |
| 2,218,452 | 10/1940 | Jackson | 53/317 X |
| 2,638,258 | 5/1953 | Bowen | 53/317 X |
| 2,695,125 | 11/1954 | Bowen | 53/317 X |
| 3,270,487 | 9/1966 | Tchimenoglov et al. | 53/367 X |
| 3,280,534 | 10/1966 | Hildebrandt et al. | 53/318 X |
| 3,589,103 | 6/1971 | Calvillo et al. | 53/381 A |
| 3,803,795 | 4/1974 | Ouellette | 53/381 A X |
| 3,807,134 | 4/1974 | Zalkin | 53/331.5 X |
| 3,844,093 | 10/1974 | Cato | 53/331.5 X |

*Primary Examiner*—Othell M. Simpson
*Assistant Examiner*—Horace M. Culver
*Attorney, Agent, or Firm*—Browdy and Neimark

[57] ABSTRACT

An apparatus for capping and uncapping containers includes a framework for storing screw-on caps in a number of stacked columns. A guide for aligning containers, such as bottles or vials held in a standard holder, consists of two members movable with respect to one another and defining a number of openings of adjustable size into which the containers are to project so as to become aligned with the stacked caps. An endless, cogged belt is operatively positioned within grooves formed on longitudinal surfaces of the members, portions of the cogged belt projecting into the openings defined by the members into which the containers are to project. This cogged belt in operation contacts the exterior surface of screw-on caps and turns them with respect to the threaded necks of the containers on to which they are to be placed or from which they are to be removed. The two members can be moved apart relative to one another in order to allow the necks of the containers and the caps to be positioned within the openings. A reversible, small electric motor is provided for driving the flexible, cogged belt. A foot pedal or the like is provided for selectively applying power to the electric motor, via a reversing switch which allows the electric motor to be driven in either direction.

16 Claims, 3 Drawing Figures

APPARATUS FOR CAPPING AND UNCAPPING CONTAINERS

FIELD OF THE INVENTION

This invention relates to an apparatus for capping or uncapping containers, such as bottles or vials held in a standard holder. The invention is concerned, more particularly, with an apparatus for alternatingly capping or uncapping a number of containers held in a standard holder which allows an operator to apply simultaneously or to remove simultaneously the caps from a plurality of containers held in a standard holder, without coming into physical contact with the containers or with the caps.

BACKGROUND OF THE INVENTION

In numerous research and clinical laboratories it is often necessary to uncap and reinstall caps on scintillation vials and the like. The researcher and clinician heretofore have removed and installed the caps by hand manipulation, a tedious and time-consuming technique. It is not unknown to take as long as one-half an hour to remove, to store and to reinstall about 133 caps.

During filling of the vials, spillage can often occur. The materials spilled and remaining in contact with the outside of the vials can be radioactive or have other characteristics making it undesirable for a person to touch the vials.

Automatic capping and cap-lifting machines have heretofore been known, but have not been used to any appreciable extent in laboratories.

An automatic capping machine for bottles has been disclosed in the U.S. Pat. No. 3,623,292 to Barnes which provides for a conveyor to move a line of bottles into a capping station which includes a plurality of cap-rotating units consisting of opposed rotating members disposed in close relation to the path of travel of the caps already in position on top of the moving bottles. A belt is positioned over the caps as they move through the capping station to force the caps downwardly onto the bottles. While this particular known bottle capping machine is very suitable for industrial purposes, it is clear that the bottles which are to be capped must be moved through a capping station on a conveyor and must be held against rotation. This particular known capping machine is not readily adaptable to laboratory use and would require the vials to be removed and placed individually on a conveyor prior to being capped, special instrumentalities being provided to hold the vials against rotation.

An apparatus for removing caps from containers is known from the U.S. Pat. No. 2,650,748 to Bennett et al., which like the capping machine disclosed in the aforementioned patent to Barnes, requires the bottles to be arranged individually on a moving conveyor which moves the bottles one after another into a cap-lifting station in which the caps are removed one at a time. Here again, this known cap-lifting machine requires the use of a conveyor and requires the placement of individual bottles on the conveyor. It is also clear that only one bottle is uncapped at any one time.

SUMMARY OF THE INVENTION

It is an object of the present invention to provide an apparatus for capping or uncapping containers which avoids any need for an operator to touch either the caps or the containers.

It is another object of the present invention to provide an apparatus for capping or uncapping containers which obviates the necessity of applying each cap or removing each cap separately from each container.

It is a further object of the present invention to provide an apparatus for capping or uncapping containers which can be alternatingly used for performing the capping and uncapping functions.

It is an additional object of the present invention to provide an apparatus for capping or uncapping containers which avoids the need for using a conveyor to bring the containers into a capping or uncapping station.

It is yet another object of the present invention to provide an apparatus for capping or uncapping simultaneously a plurality of containers.

It is yet a further object of the present invention to provide an apparatus for capping or uncapping containers which is compact and readily portable so as to be particularly adapted for use in laboratories.

The foregoing objects, as well as additional objects which are to become clear from the text below, are achieved in accordance with the present invention by providing an apparatus for capping or uncapping containers which includes means for storing numbers of caps, means for guiding a plurality of containers into a given geometric relationship to each other in the vicinity of the means for storing, and means for simultaneously moving respective caps associated with respective ones of containers of the plurality of containers.

In a particularly advantageous embodiment of the present invention, the means for moving the caps is constituted by a flexible, endless, cogged belt which rotates respective ones of the caps relative to the containers, the belt being driven by an electric motor. The electric motor preferably includes a reversing switch which changes the direction of rotation of the motor to effect reversal of the direction of movement of the belt so as to either remove or apply the caps to the containers as the operator desires. Power is supplied to the electric motor via an additional switch, which desirably may be constituted by foot-operated switch.

In a preferred embodiment of the present invention, the means for storng the caps, the means for guiding the containers and the means for moving the caps are removably mounted on a pedestal and preferably can be swiveled about an axis perpendicular to the pedestal.

In a illustrative, practical embodiment of the present invention the means for guiding a plurality of containers is constituted by two separate members which together define a plurality of openings into which the plurality of containers is to project. The openings are aligned with respective ones of a plurality of stacks of caps held within storing channels of the storing means. At least one of the two separate members constituting the means for guiding the containers is movable in a plane relative to the other member to effect an enlargement of the openings and a spreading of the belt. This allows the containers to project into the openings and the caps to be positioned between spans of the belt.

A mechanism is coupled to at least one of the separate members for selectably moving this member in a plane relative to the other member from a first position with opposed spans of the belt at a given distance from one another to a second position with the spans of the belt at a distance from one another greater than the given distance. The given distance is less than the diameter of the caps to be stored. Thus the caps may contact the belt without becoming positioned between the belt spans, unless the separate members have been moved apart. The members are spring-biased in a direction urging the members toward one another.

DETAILED DESCRIPTION OF THE PREFERRED EMBODIMENT

Figure 1:
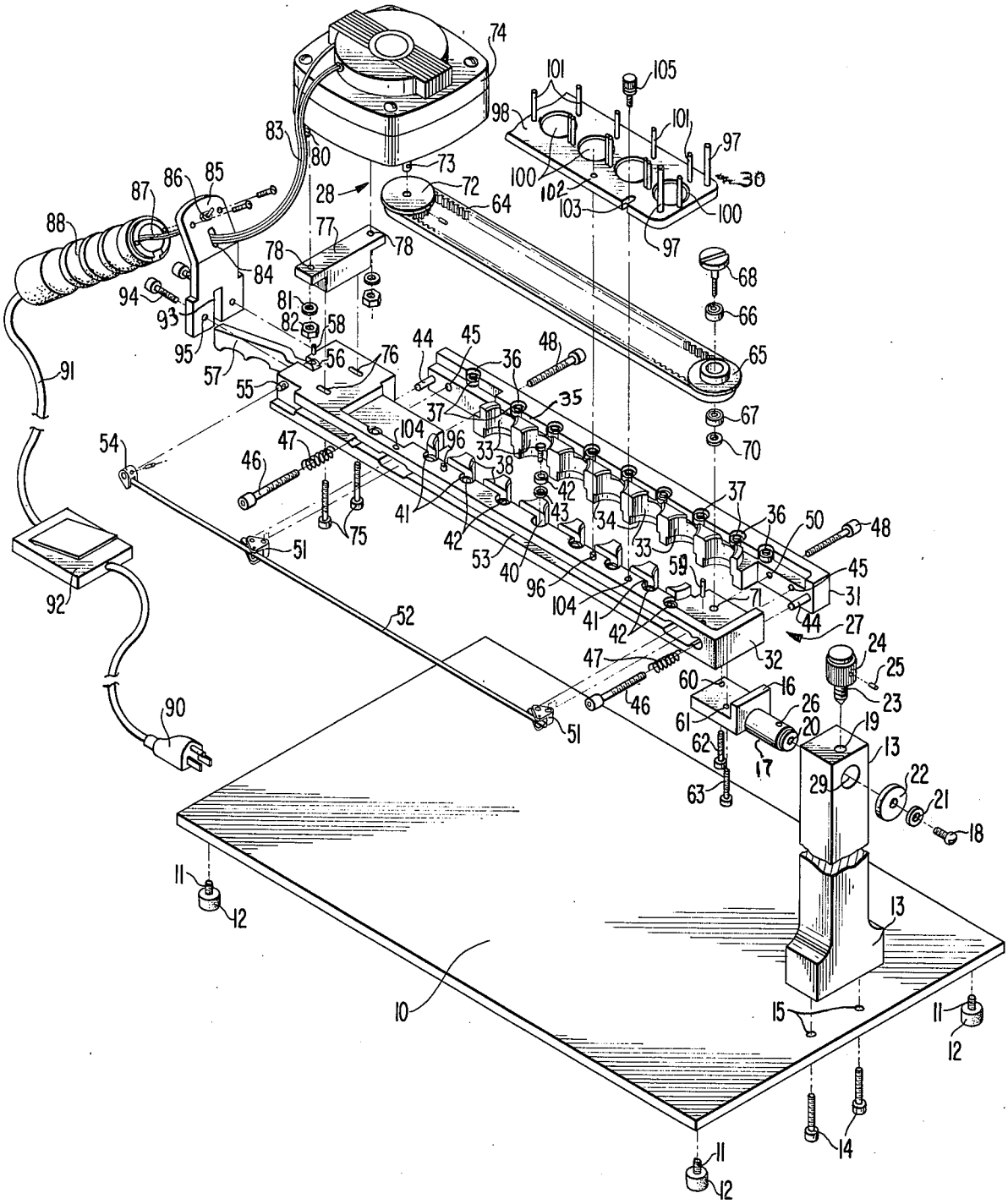
FIG. 1 is an exploded pictorial view of an illustrative embodiment of an apparatus for capping or uncapping containers according to the present invention.

Turning to FIG. 1, an illustrative apparatus for removing or applying caps to containers includes a rectangular base plate 10 of aluminum. The underside of the base plate 10 is provided with four blind bores in the vicinity of its four corners. Four screws 11 are positioned respectively in the blind bores. Each of the screws 11 carries a screw-on head 12 made of a resilient material, such as rubber, which is to contact the surface of a work bench or the like and support the apparatus against movement. A pedestal 13 of aluminum is fixably connected to the base plate 10 by two tension screws 14 which extend respectively through bores 15 in the base plate 10 in the vicinity of one of its narrower sides, these tension screws 14 extending into bores in the lower face of the pedestal 13. An aperture 29 is provided near the top of the pedestal 13. An L-shaped bracket 16 having an integral cylindrical boss 17 extending outwardly therefrom is supported by the pedestal 13, the boss 17 being positioned within the aperture 29 for possible rotation therein. The boss 17 thus functions as a bearing held against axial movement in the aperture 29 by a screw 18 which extends into a threaded bore 20 centrally located in the boss 17. A thrust bearing 22 and a conventional washer 21 are positioned between the head of the screw 18 and a flat surface of the pedestal 13. The pedestal 13 is provided with a threaded bore 19 which intersects the aperture 29 . A set screw 23, having a knurled head 24 fixedly connected thereto by a screw 25 extends into the threaded bore 19 so as to come into contact with one or another of a plurality of bores 26 formed in the cylindrical surface of the boss 17. Only one of bores 26 is visible in FIG. 1. It is to be appreciated that additional bores are provided or may be provided in the cylindrical surface of the boss 17 at various points where it is desired to fix the boss 17 against rotation. Thus, a bore may be provided, for example, in the cylindrical surface of the boss 17 at an angular spacing of substantially 190° to the bore 26 visible in FIG. 1. This permits the L-shaped bracket 16 to be rotated to various positions, including a position 180° from that shown, and to be fixed in these positions by simple manipulation of the knurled head 24 associated with the set screw 23.

The apparatus for capping or uncapping containers, as shown in FIG. 1, includes additionally container aligning device designated generally by the numeral 27, a means 28 for driving the caps to be placed on or removed from the containers, and a device 30 for storing the caps in a plurality of stacked columns.

The device 27 for aligning the containers is constituted by two separate members 31 and 32 made of aluminum. The member 31 includes a number of inwardly positioned projections which define seven semi-cylindrical openings 33, each of the openings 33 being counterbored to provide counterbores 34, which define a somewhat enlarged opening toward the lowermost portion of each of the openings 33, as visible in FIG. 1. A slot 35 extends longitudinally along the upper surface of the member 31, the slot 35 intersecting with the semi-cylindrical walls which define the openings 33. The upper surface of the member 31 is also provided with a number of cylindrical depressions 36 spaced along its length, these depressions 36 are so positioned that they open into the groove 35. A respective ball bearing 37 is provided within each of the depressions 36, its operative bearing surface extending outwardly into the slot 35. Each of the ball bearings 37 is held in position by a conventional screw. The other member 32 of the container aligning device 27 includes projections which define seven respective semi-cylindrical openings 38 which are aligned opposite the corresponding respective semi-cylindrical openings 33 in the first member 31. Each of the semi-cylindrical openings 38 are counterbored at their lowermost extent (not visible in FIG. 1) to the same extent as the counterbores 34 associated with the semi-cylindrical openings 33. The longitudinally extending upper surface of the member 32 is provided with a groove 40 which runs parallel to the groove 35 provided in the upper longitudinally extending surface of the member 31. The groove 40, similarly to the groove 35, opens into each of the semi-cylindrical surfaces which define the openings 38. A number of substantially cylindrical depressions 41 are provided in the upper surface of the member 32 at spaced distances therealong. At least some of these substantially cylindrical depressions 41 open into the groove 40. A respective ball bearing 42 is respectively positioned in each of the substantially cylindrical depressions 41 with its operative surface extending slightly into the groove 40. The ball bearings 42 are held in place in the depressions 41 by respective screws and are spaced from the bottom of these depressions by a respective spacing washer 43, only one being visible in FIG. 1. It is to be understood that the ball bearings 37 are similarly spaced from the bottom of the depressions 36 by washers which correspond to the washer 43 visible in FIG. 1, and associated with one of the depressions 41.

The member 31 is provided with two bosses 44 which are positioned within respective bores in the manner 32 so as to align the semi-cylindrical openings 33 in the member 31 with corresponding ones of the semi-cylindrical openings 38 of the member 32. The inwardly facing surface of the member 31 is provided with two threaded bores 45 in the vicinity of the bosses 44. Negative tension screws 46 through apertures in the member 32, which are not visible, and are arranged in threaded connection with the respective bores 45 in the member 31. Each of the negative tension screws 46 are coaxially arranged with respective springs 47 which contact a land within the bores in the member 32 through which the respective screws 46 extend so as to provide a biasing force against the head of the screws 46 thereby pulling the member 31 toward the member 32. Adjustable set screws 48 extend through respective apertures 50 in the member 31 and thereafter through corresponding apertures not shown in the member 32 as to contact respective eccentrics 51 which are carried on a connecting shaft 52 positioned within a groove 53 which extends longitudinally along a side surface of the member 12. The adjustable, positive tension screws 48 serve the purpose of providing a stop to arrest movement of the member 31 toward the member 32 under the action of the springs 47 so as to define the minimum separation of the openings 33 from the openings 38 in an adjustable manner. Thus the minimum distance between the openings 33 and the openings 38 can be adjusted by positioning the screws 48 to accommodate containers of different sizes.

The connecting shaft 52 is provided on its end shown to the left in FIG. 1 with an eccentric 54 which in turn is connected to a shaft 55 rotationally positioned within the member 32 and fixed to an end 56 of a handle 57 by a pin 58. One of the eccentrics 51, shown to the right of FIG. 1, is held in place for pivoting in the member 32 by a pin 59 which extends through a bore in the member and a bore in this particular eccentric 51. Movement of the handle 57 causes the eccentric 54 to move the connecting shaft 52 in a longitudinal direction. This is turn causes the eccentrics 51 which are in contact with the ends of the adjustable tension screws 48 to move thereby pushing against the tension screws 48 causing the member 31 to move away from the member 32 making it easy to position a plurality of the containers within the opposed semi-cylindrical openings 33 and 38. It is to be noted that the same action of the inclined surfaces of the eccentrics 51 on the ends of the adjustable tension screws 48 serve to increase the separation of the grooves 35 and 40 from one another.

The L-shaped bracket 16 is provided with a pair of apertures 60 and 61 through which screws 62 and 63 respectively extend. The screws 62 and 63 are positioned within threaded bores in the underside surface of the member 32 so as to fix the container aligning device 27 to the L-shaped bracket 16.

The means 28 for moving the caps to be applied or removed from the containers includes a flexible, cogged belt 64 which is positioned within the grooves 35 and 40 and about an idler cog wheel 65 positioned for rotation about a pair of roller bearings 66 and 67, the cog wheel 65 being held in place by a screw 68 which extends through the roller bearings 66 and 67 and a washer 70 into a threaded bore 71 provided in the member 32.

The other end of the flexible cogged belt 64 is positioned about a driven cog wheel 72 fixedly connected to a drive shaft 73 of a small electric motor 74. The motor 74 can be constituted, for example, by a Bodine Motor Model 5611410, Type KGL-23RB. This particular motor has a torque of 14 inch-ounces and operates from a 115 Volt power supply with a speed of 56 rpm. It is to be appreciated that the belt 64 may be rotated at lower or higher speed if desired, but that a speed of 54 rpm has been found to be suitable for many applications. Speed of up to 100 rpm and even greater speeds are nevertheless possible.

The motor 74 is fixed to the member 32 by two bolts 75 which extend upwardly through a pair of slots 76 formed in the member 32 near its end opposite to that which is fixed to the L-shaped bracket 16. The slots 76 are provided for the purpose of allowing the motor to be moved longitudinally along the member 32 to a limited extent so as to provide an adjustment in the tension of the belt 64. The bolts 75 extend upwardly into bores (not visible in FIG. 1) in a block 77 having two apertures 78 therein through which a pair of bolts 80 extend downwardly from the motor 74 as viewed in FIG. 1, only one of the bolts 80 being visible in FIG. 1. Each of the bolts 80 extend through the respective apertures 78 and a respective lock washer 81 in threaded engagement with a respective nut 82. Electrical energy for the electric motor 74 is provided by power leads 83 which extend through an aperture 84 in a bracket 85 to a polarity reversing switch 86 carried by the bracket 85. Power to the polarity reversing switch 86 is supplied by leads 87 which extend through a handle 88 to a male plug 90, via a power cord 91 interrupted by a treadle-operated switch designated generally by the numeral 92. The treadle-operated switch 92 serves as a turn-on device for the motor 74, the polarity reversing switch 86 determining which of the two directions of rotation the motor 74, and thus the belt 64, is to have. The direction depends on whether one wishes to remove or apply caps to the containers. It is desirable that the polarity reversing switch 86 be a three-position switch, its center position being an off position. This type of switch can be used to interrupt power to the motor 74 as well as reverse the current applied thereto, thereby allowing the apparatus to be operated without use of the treadle-operated switch 92 if desired.

The bracket 85 includes a slot 93 through which the handle 57 can extend so as to place it desirably in the vicinity of the handle 88. The bracket 85 is connected fixedly to the member 32 by two screws 94, which extend through respective apertures 95 in the bracket 85 into threaded bores (not visible in FIG. 1) in the member 32.

Two dowel posts 96 extend upwardly from that surface of the member 32 in which the groove 40 is provided.

The storage device 30 for caps to be applied to or removed from containers is shown partially in FIG. 1 for the purpose of clarity. The device 30 includes a pair of plates which are spaced apart and held in parallel arrangement by four rods connected between the plates near the corners thereof, only the bottom plate 98 and two of the rods 97 being visible in FIG. 1. A plurality of apertures 100 through which the the caps are to move are provided in spaced relation along the plate 98, only four of the apertures 100 of seven in the illustrative embodiment, being visible in FIG. 1. Three respective rods 101 are positioned near the perimetor of each of the apertures 100 so as to provide guides for the caps and to assure that they extend in stacked relationship in substantially axial alignment with the respective apertures 100. The plate 98 is provided with a plurality of guide holes 102 into which the dowel pins 96, extending upwardly from the member 32, extend so as to align the apertures 100 of the plate 98 above the semi-cylindrical openings 33 and 38, and in substantial axial alignment therewith. The plate 98 is provided with two slots 103 which extend inwardly from one of its longer edges and are positioned over respective threaded apertures 104 formed in the upper surface of the member 32 when the dowel pins 96 extend through the apertures 102, only one slot 103 being visible in FIG. 1. A respective locking screw 105 is threadedly engaged in each of the threaded apertures 104 and extends through the slot 103 in the plate 98 to fix the cap storing device 30 to the member 32.

Figure 2:
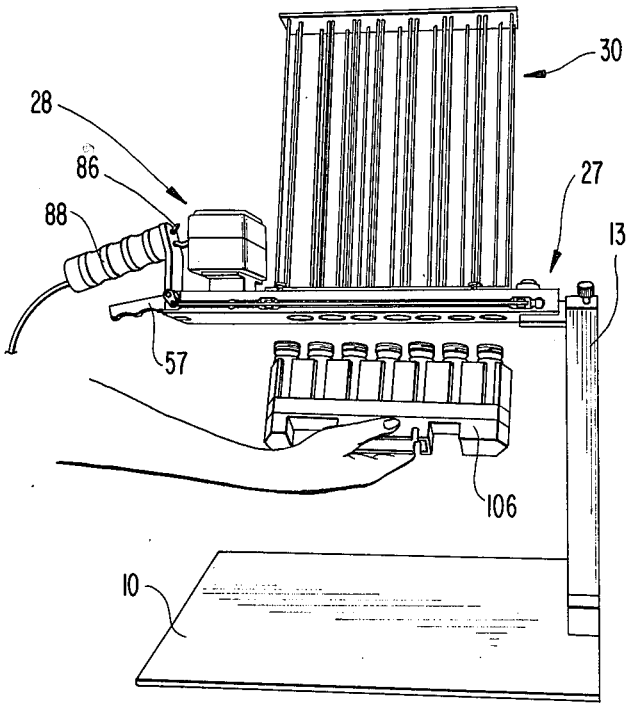
FIG. 2 is a pictorial view of the apparatus of FIG. 1, shown in an orientation particularly suitable for removing caps from vials held in a conventional holder.

As shown in FIG. 2, the apparatus for applying and removing caps from containers is shown in a orientation particularly suitable for placing caps on the container. To ready the apparatus for applying caps, a user stacks caps in the storage device 30 in the event such caps are not already positioned therein. In the illustrative embodiment seven stacks of caps are provided. The lowermost of the caps is positioned against the belt 64 and extend through the apertures 100, but do not extend between the spans of the belt 64, because the distance between the spans is somewhat less than the diameter of the caps. The user moves the switch 86 to a suitable position for rotating the belt 64 in a direction to screw caps onto the tops of containers, and plugs the plug 90 into a suitable wall socket.

The user then brings a conventional holder 106 having seven filled vials therein to a position beneath the semi-cylindrical openings 33 and 38 of the container aligning device 27. The user then moves the handle 57 to a position which effects the slight movement of the member 31 away from the member 32 by action of the eccentrics 51 on the adjustable tension screws 48. This causes a respective cap from each of the seven stacks of caps in the storage device 30 to exit from the device 30 and become positioned between the now slightly separated spans of the cogged belt 64. The movement of the member 31 away from the member 32 also makes it easier to insert the seven filled vials into the container aligning device 27. Once the caps are thus positioned between the spans of the belt 64, the operator moves the handle 57 to its original position, resulting in movement of the member 31 toward the member 32 causing the caps to become clamped to a degree between the spans of the belt 64. The operator then depresses the treadle switch 92 to effect rotation of the caps so as to screw them onto the filled vials. It is to be appreciated that by merely reversing the current to the motor 74 by the action of the switch 86, it would be possible to unscrew caps from the vials, be they filled or empty, by action of the moving belt 64, then to separate the spans of the belt 64, by manipulation of the handle 57, and to gently push the conventional holder containing the vials upwardly so as to cause the now removed caps to enter the cap storing device 30. Whereupon the user would return the handle 57 to its original position, causing the spans of the belt 64 to again be positioned sufficiently close to one another so that the caps within the cap storage device 30 cannot fall out of the storage device.

Figure 3:
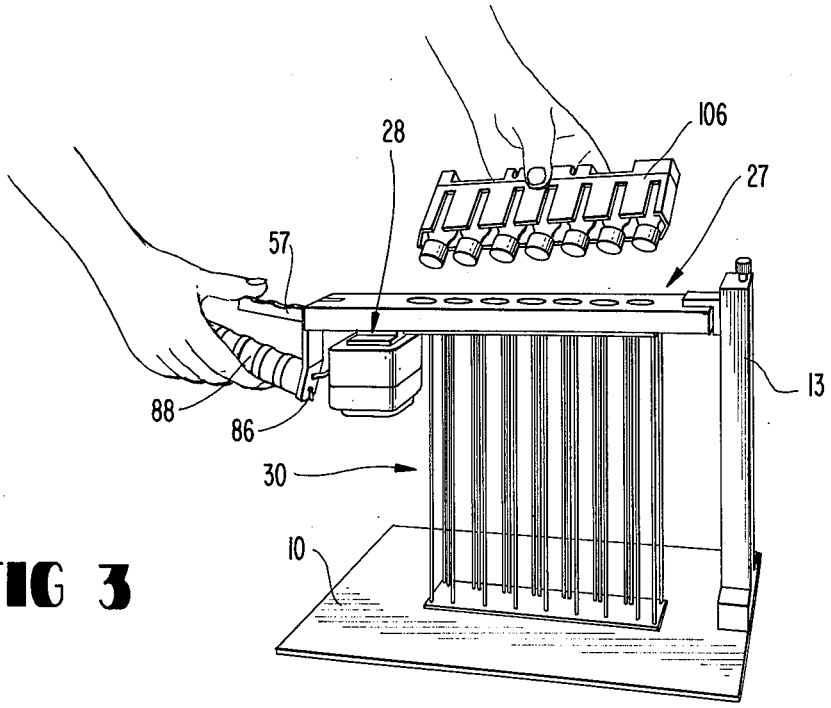
FIG. 3 is a pictorial view of the apparatus of FIG. 1, shown in an orientation particularly suitable for applying caps to vials held in a conventional holder.

Turning now to FIG. 3, the apparatus for capping or uncapping containers is shown in an orientation particularly suitable for removing caps from empty vials. As can be seen in FIG. 3, the container aligning device 27, the means generally designated by the numeral 28 which effects movement of the caps, and the cap storage device 30 have been inverted, so that the cap storage device 30 extends downwardly from the container aligning device 27. The change in orientation between the apparatus shown in FIG. 2 and FIG 3 is effected, reference being made to FIG. 1, by simply releasing the set screw 23 and rotating the boss 17 within the aperture 29 in the pedestal 13 180°, thereafter setting the set screw 23 to fix the boss 17 against further rotation.

As shown in FIG. 3, a user seeking to remove caps from vials would simply place the switch 86 in a position to provide for that direction of rotation of the belt 64 which will effect the unscrewing of caps from vials. The user then brings a conventional vial holder 106 into position in the vicinity of the seven openings defined by the container aligning device 27, and moves the handle 57 so as to spread the spans of the belt 64 far enough apart to allow the caps on the vials to become positioned between the spans of the belt 64. The user then returns the handle 57 to its original position, causing the belt 46 to contact the caps on the vials. The user then depresses the treadle switch 92 which causes the motor 74 to move the belt 64 unscrewing the caps from the vials held in the conventional carrier 106. When the caps have been unscrewed from the vials, the operator simply moves the lever 57 to its other position spreading the belt 64 thereby allowing the caps to descend through the apertures 100 into the storage device 30.

It is to be appreciated that the apparatus according to the present invention can be operated without being positioned on the pedestal 13 and in numbers of applications need not be associated with a treadle switch.

The screws, bolts and bearings used in the present device are desirably made of stainless steel while the major parts are desirably made of aluminum so as to provide for lightness of weight. In one practical embodiment of the present invention the entire apparatus weighs less then 5 pounds, including the pedestal and its associated base plate.

The foregoing description and accompanying figures of drawings relate to a single, preferred embodiment of an apparatus for capping or uncapping containers, which embodiment has been set out by way of illustration and not by way of limitation. It is to be appreciated that other embodiments and numerous varients are possible within the spirit and scope of the present invention, its scope being defined by the appended claims.

What is claimed is:

1. An apparatus for capping and uncapping containers, the apparatus comprising means for storing numbers of caps, means for guiding a plurality of containers into a given geometric relationship to each other in vicinity of said means for storing, an endless belt having oppositely directed spans between which a plurality of the caps are to be positioned, means for bringing said belt into contact with caps which are to be positioned between said spans, and reversible motor means for driving said belt to effect simultaneous rotation of caps between said spans with respect to the plurality of containers selectively to cap or to uncap these containers.

2. An apparatus according to claim 1, wherein said belt is a flexible, endless cogged belt and wherein said spans are positioned within said means for guiding.

3. An apparatus according to claim 1, wherein said motor means includes a switch means for reversing direction of rotation of said motor means to effect reversal of direction of movement of said belt whereby caps may be alternatively applied to and removed from the containers.

4. An apparatus according to claim 3, including a further switch means for supplying power to said motor means.

5. An apparatus according to claim 4, wherein said further switch means comprises a foot-operated switch.

6. An apparatus according to claim 1, including switch means for supplying power to said motor means.

7. An apparatus according to claim 6, wherein said switch means comprises a foot-operated switch.

8. An apparatus according to claim 1, including pedestal means, said means for storing and said means for guiding and said motor means being mounted on said pedestal means.

9. An apparatus according to claim 8, wherein said means for storing and said motor means guiding and said means for are removably mounted on said pedestal means.

10. An apparatus according to claim 8, wherein said means for storing and said means for guiding and said motor means are movably mounted on said pedestal for selective movement about a given axis, and including means for adjustably fixing said means for storing and said means for guiding and said motor means against rotation about said axis.

11. An apparatus according to claim 1, wherein said means for guiding includes two separate members defining a plurality of openings into which the plurality of containers is to project, wherein said means for storing include a plurality of storing channels for storing stacks of caps, said plurality of storing channels corresponding in number to the number constituting said plurality of openings and each channel being in substantial axial alignment with a respective corresponding one of said openings.

12. An apparatus according to claim 11, wherein at least one of said two separate members is movable in a plane relative to the other member to effect an enlargement of said openings for allowing containers to project into said openings.

13. An apparatus according to claim 11, wherein said separate members have respective grooves therein which open into side walls of said openings, said spans of said belt being arranged within said grooves, and wherein said means for bringing said belt into contact with caps comprise means coupled to at least one of said separate members to move these members with respect to one another.

14. An apparatus according to claim 13, wherein at least one of said two separate members is movable in a plane relative to the other member to effect an enlargement of said openings and a spreading of said belt for allowing containers to project into said openings and caps to be positioned between spans of said belt.

15. An apparatus according to claim 13, including means coupled to said at least one of said two separate members for selectively moving these members in a plane relative to one another from a first position with opposed spans of said belt at a given distance from one another to a second position with said spans of said belt at a distance from one another greater than said given distance, said given distance being less than the diameter of said caps to be stored whereby caps in said means for storing may contact said belt without passing between said spans of said belt.

16. An apparatus according to claim 15, including biasing means for urging said at least one of said two separate members toward the other of these members, said means for selectively moving said members acting against force of said biasing means.

* * * * *